United States Patent [19]

Warner et al.

[11] Patent Number: 4,882,879

[45] Date of Patent: Nov. 28, 1989

[54] FLEXIBLE ABRASIVE GRINDING TOOL

[75] Inventors: R. Brown Warner, Westlake; Alfred F. Scheider, Orange, both of Ohio

[73] Assignee: Jason, Inc., Cleveland, Ohio

[21] Appl. No.: 216,709

[22] Filed: Jul. 8, 1988

[51] Int. Cl.[4] ..... B24B 9/02

[52] U.S. Cl. ..... 51/337; 51/334

[58] Field of Search ..... 51/337, 334, 332, 331, 51/330, 336; 15/104.03, 104.05, 104.09, 104.1, 104.9, 159 R, 162, 164

[56] References Cited

U.S. PATENT DOCUMENTS 2,049,324 7/1936 Schneider ..... 51/337

4,756,044 7/1988 Clark ..... 51/332

*Primary Examiner*—Frederick R. Schmidt

*Assistant Examiner*—Maurina Rachuba

*Attorney, Agent, or Firm*—Renner, Otto, Boisselel & Sklar

[57] ABSTRACT

A flexible abrasive rotary tool includes a hub adapted to be driven for rotation. Secured to the hub are discrete bristle tufts of stiff yet flexible abrasive loaded plastic monofilaments which project radially outwardly and then circumferentially away from the intended direction of rotation of the tool in the general form of a spiral so that the filaments of the distal end of each tuft extend generally circumferentially and overlies the filaments of the next adjacent tuft. The outer end of each tuft is resiliently radially supported by such adjacent tufts. The bristle monofilaments are preferably nylon and loaded with about forty-five percent of abrasive material and have a rectangular or somewhat oval sectional configuration so that the wider side of the monofilament forms the tool face. The tool has a number of applications but is particularly adapted to be circumferentially compressed into a bore or cylinder, such as that of an internal combustion engine. The rotary tool also deburrs and properly finishes the edges of any ports such as cylinder ports. The invention includes not only the method of finishing or honing such surfaces but also the method of making the tool and replacement tufts.

23 Claims, 2 Drawing Sheets

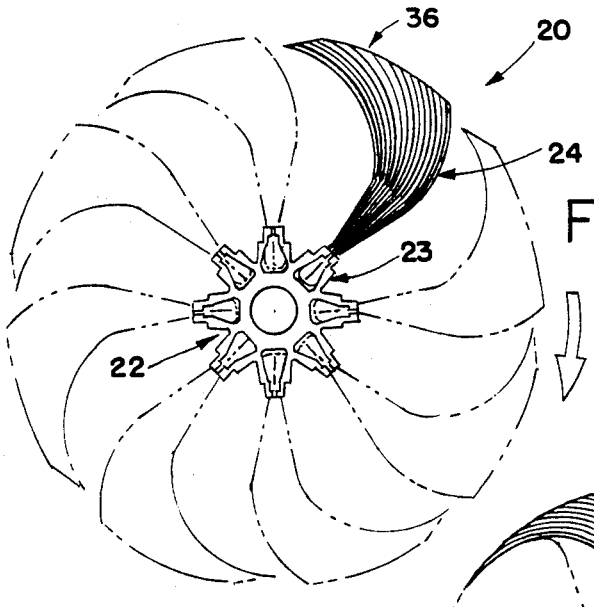
FIG. 1
FIG. 2
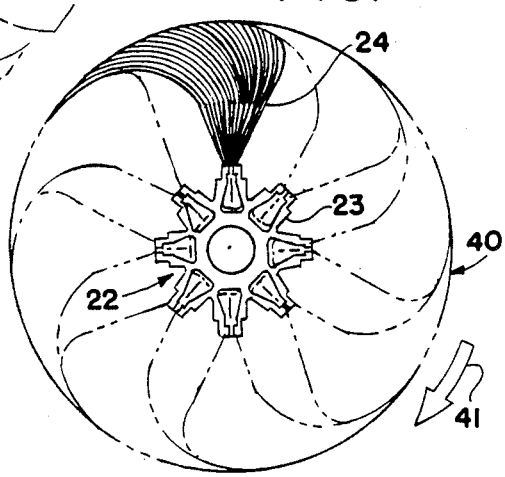
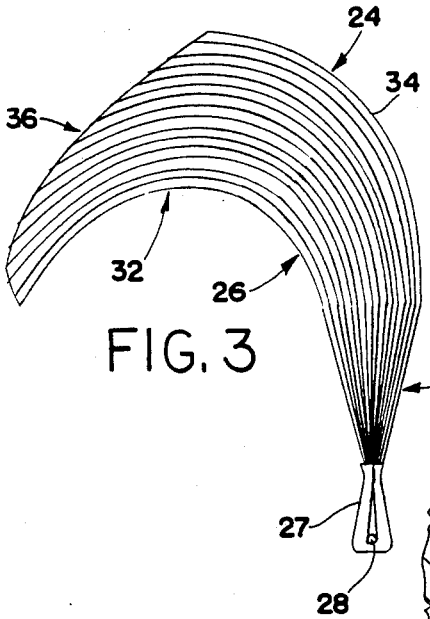
FIG. 3
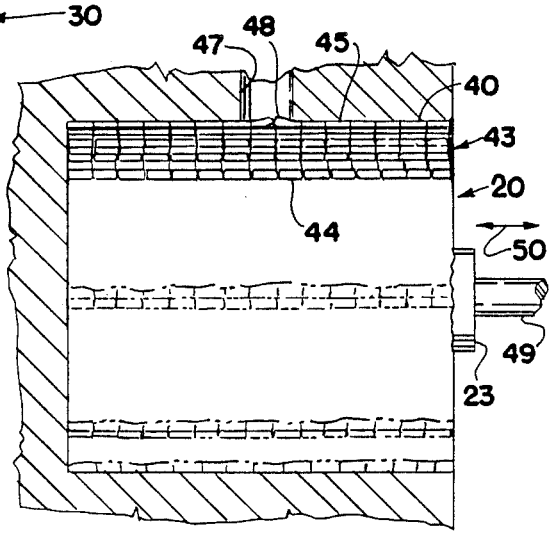
FIG. 4

FLEXIBLE ABRASIVE GRINDING TOOL

DISCLOSURE

This invention relates generally as indicated to a flexible abrasive grinding tool and more particularly to a rotary abrasive brush or hone ideally suited for finishing interior cylindrical surfaces. The invention also relates to a method of making the tool.

BACKGROUND OF THE INVENTION

Rotary abrasive tools particularly designed for cleaning or finishing interior cylindrical surfaces such as engine cylinder walls are employed both in rebuilding of engines and in original engine manufacture. The walls of such cylinders are required to have special surface finishes to enable the proper retention and distribution of lubricating oils. In engine rebuilding, the cylinder walls must also be cleaned of any glaze or deposit which builds up on the cylinder or valve seat walls in addition to imparting the lubricating oil holding finish. Examples of special abrading tools for such purposes may be seen in U.S. Pat. Nos. 3,384,915 and 3,871,139.

Such abrasive hones or brushes employ a round enlarged spherical globule of abrasive material on the tip of flexible nylon bristles. As in a round filament brush the initial contact with the work is a point and the abrasive loaded element then wears back to a flat. If a flat sided filament can be properly positioned against the interior surface to be honed or finished it has been found that more work per unit time can be achieved while properly finishing or cleaning the interior of the cylinder and also edges such as valve ports. Also, more consistent part-to-part results can be achieved.

SUMMARY OF THE INVENTION

A flexible abrasive rotary tool includes a hub adapted to be driven for rotation. Secured to the hub are discrete bristle tufts of stiff yet flexible abrasive loaded plastic monofilaments which project radially outwardly and then circumferentially away from the intended direction of rotation of the tool in the general form of a spiral so that the distal end of each tuft overlies the proximal end the next adjacent tuft, and is resiliently radially supported by such adjacent bristle tufts. The bristle monofilaments are bent to extend circumferentially of the hub and are preferably nylon and loaded with about forty-five percent of abrasive material. The filaments have a rectangular or somewhat oval sectional configuration so that the wider side of the monofilament forms the tool face. The tool has a number of applications but is particularly adapted to be circumferentially compressed into a bore or cylinder, such as that of an internal combustion engine. The rotary tool for such purpose also deburrs and properly finishes the edges of any ports such as cylinder ports. The invention includes not only the method of finishing or honing such surfaces but also the method of making the tool and replacement tufts.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 1 is an end elevation of a rotary tool of the present invention prior to insertion into a cylinder;

FIG. 2 is an end elevation of the tool following insertion illustrating how the tool constricts;

FIG. 3 is an enlarged end elevation of a replacement tuft or strip;

FIG. 4 is a fragmentary axial section of the tool in a cylinder showing the manner in which the filaments wipe the interior surface and engage edges such as at ports;

DETAILED DESCRIPTION OF THE PREFERRED EMBODIMENTS

Figure 5:
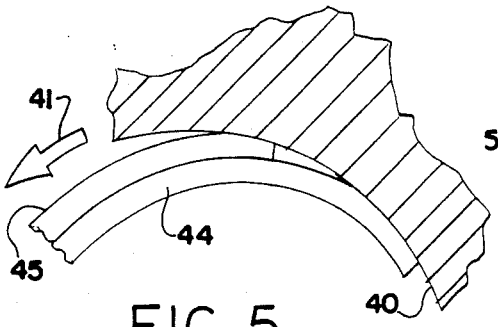
FIG. 5 is an enlarged transaxial fragmentary section showing the filament overlap and the manner in which the flat side of the filament wipes the interior of a cylinder.

Referring first to FIG. 1 there is illustrated a flexible abrasive grinding tool or hone 20 in accordance with the present invention. The tool includes a hub 22 which may be mounted on an arbor for rotation of the tool in a clockwise direction as viewed in FIG. 1. The hub includes a series of radially projecting channels 23 into which tufts, strips or rows of abrasive loaded plastic monofilaments shown generally at 24 are positioned. The tufts or strips may be inserted endwise into the channels 23 and may be locked in place.

As illustrated, there are eight equally circumferentially spaced individual tufts or rows in the tool of FIG. 1 and as seen in FIG. 3 each tuft comprises a group of abrasive monofilaments 26 which are encased in a channel 27 and folded around a retaining rod or wire 28 to form the dovetail type channel which may be slid endwise into the channel 23. The individual filaments which form the tuft or row are preferably rectangular plastic filaments each having embedded therein in excess of 30% and preferably about 45% abrasive minerals. The flat sides of major extent are parallel to the axis of the work.

As indicated in FIGS. 1 and 3, the filaments extend from the channel 27 symmetrically and begin to flare as indicated at 30. However, shortly after leaving the channel 27 the filaments curve each in a common direction, in the general formula of a spiral as indicated at 32. Such curvature is away from the intended direction of rotation of the tool. It will be seen that the filaments on the downstream side of the tuft or row curve to a greater extent than the filaments on the upstream side indicated at 34. Also, the ends of the filaments indicated at 36 may be trimmed to provide a generally circular face for the tool. Because of the curvature of the filaments and the trimming operation the filaments on the upstream side of the tuft or row may actually be somewhat shorter than the filaments on the downstream side. The filaments are then bent in the gradual curvature illustrated to extend radially at their inner ends and then generally circumferentially at their outer ends. This presents the forward facing side of the filaments to the work to be in effect wiped therealong.

Such abrasive loaded plastic filaments are relatively stiff yet flexible and may be set in such curvature indicated by partial heating followed by cooling. Each tuft or row may be positioned between curved mating dies to obtain the desired degree of curvature or the entire tool may be circumferentially constricted as seen in FIG. 2 to bend the filaments to the desired curvature following partial heating. Upon cooling, the filaments take on the curved set indicated.

Referring now to FIG. 2 it will be seen that the tool after being inserted in the cylindrical surface 40 such as an engine block cylinder is circumferentially constricted so that the degree of curvature of each filament is even more pronounced. The tool may then be rotated in the direction of the arrow 41 to clean and finish the interior surface of the cylinder. When the tool is constricted in such cylinder and rotated in the counterclockwise direction noted, curved tufts or rows will overlie the filaments of the next adjacent tuft or row to present the filaments in layers as indicated at 43 in FIG. 4. The underlying filaments indicated at 44 act as springs or cushions urging the overlying filaments 45 against the work to obtain a wiping action of the flat face of such filaments against the surface 40 being finished.

In FIG. 4 there is illustrated a port 47 and it will be seen that the filaments flex within such port as indicated at 48 to finish properly the edges of the port as it opens into the cylinder. Also in FIG. 4 the tool is shown mounted on an arbor 49 which may be reciprocated as indicated by the arrow 50 to provide a special or patterned scratch finish to the interior of the cylinder.

Because of the flat faces on the filaments and the increased abrasive loading thereof the tool provides more work per unit time than a conventional rotary brush using round filaments or an abrasive hone as noted in the aforementioned patents.

As seen in FIGS. 4 and 5 it is the flat side of the filament which wipes over the work producing a flat surface contact thus maximizing the abrasive mineral contact with the work surface which produces of course more work per unit of time. The compressed spring or set of the filaments urges the flat side of the filament into engagement with the work to produce such wiping action.

It will of course be understood that either end of the tool may be inserted into the cylinder and the tool may then be rotated in opposite directions to facilitate the wiping finish of opposite edges of ports, seats slots, bores, etc. such as indicated at 47.

Figure 6:
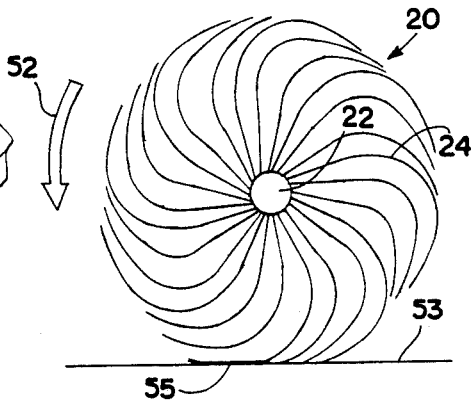
FIG. 6 is a schematic end elevation of the tool employed to finish, debur or condition a flat surface.

Also seen in FIG. 6 the tool shown schematically at 20 may be rotated in the direction of the arrow 52 to finish a flat surface 53 with the set curvature of the filaments causing the flat engagement seen at 55. Applying more pressure to the work surface by bringing the hub closer to the work surface simply flexes the filaments to a greater extent and also creates more cushion or spring action by the interaction of adjacent tufts or rows.

Figure 7:
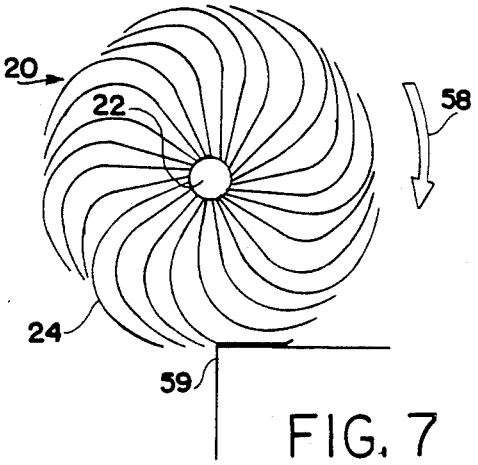
FIG. 7 is a similar view showing the tool working on a corner.

In FIG. 7 there is illustrated a tool 20 rotating in the direction of the arrow 58 to abrade or finish a corner 59. As the curved set filament leaves the corner 59 it will not snap back to its original position to the extent a radial filament would. Such excessive snap back or flexing of radial filaments generally continues throughout the portion of the rotation of the tool when the filament is not in engagement with the work and contributes to filament fracture. It is noted that in FIG. 7 the tool may be traversed around the corner 59 being finished to provide excellent radius forming and burr removal.

Figure 8:
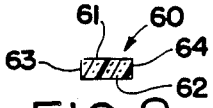
FIG. 8 is an enlarged transverse section of the preferred abrasive loaded filament for use with the present invention.

In FIG. 8 there is illustrated an enlarged cross section of the preferred filament used with the present invention. Such filament is shown generally at 60 and includes two flat sides 61 and 62 of major extent and edges 63 and 64. The flat major extent sides of the filament will be oriented in the tool so as to be generally parallel to the axis of the tool. For example, it will be the outer or forward facing elongated flat side 61 which wipes over the work in obtaining a substantial area contact with the work and avoiding the point contact obtained with round filaments or spherical globules of abrasive material.

As indicated in applicant's copending application entitled "Rotary Abrasive Tool and Filament Therefor" filed even date herewith, the larger cross sectional area of the filament and its configuration permits a higher abrasive loading than with conventional round filament. Such filament is preferably a nylon matrix which has an abrasive mineral loading in excess of 30% and preferably about 45% by weight. The abrasive may be for example aluminum oxide or silicon carbide or more exotic abrasive such as polycrystalline diamond.

In the preferred form the rectangular filament is at least twice as wide as it is thick and may be of a width three to four times its thickness. One particular size for such filaments which has been found useful is a filament 0.090 inch wide and 0.045 inch thick.

Figure 9:
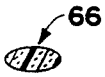
FIGS. 9–12 are similar sections of other forms of filaments.
Figure 10:
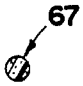

Other filament sectional configurations may be used with the preset curvature tool of the present invention such as the filament 66 seen in FIG. 9 of elliptical configuration. The filament of FIG. 9 has a major axis of substantial extent.

Figure 11:
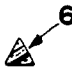
Figure 12:
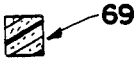

A conventional round filament indicated at 67 may be employed with the set curvature tool of the present invention. In FIG. 11 there is illustrated a triangular filament 68 and in FIG. 12 a square filament 69.

In any event the filaments and tufts formed thereby have a preset curvature in the general form of a spiral so that the filament is curved so that the working face becomes the side of the filament rather than the tip. This then presents more abrasive material to the work surface and permits the tool to do a substantial amount more of work per unit time.

As indicated in FIG. 3 the tool of the present invention is such that when the tufts or rows become worn they may readily be replaced with tufts as seen in FIG. 3 having the spiral set curvature to the filaments.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A flexible abrasive grinding tool comprising a hub, discrete bristle tufts of stiff yet flexible abrasive loaded plastic filaments secured to said hub and projecting radially outwardly and then curving circumferentially; said filaments being elastically shaped to form a predetermined curve which retains a curved shape.

2. A tool as set forth in claim 1 wherein said plastic filaments curve circumferentially away from the intended direction of rotation of the tool.

3. A tool as set forth in claim 1 wherein the distal end of each tuft overlies the proximal end of the next adjacent tuft.

4. A tool as set forth in claim 2 wherein the distal end of each tuft overlies the proximal end of the next adjacent tuft.

5. A tool as set forth in claim 2 wherein the curvature of the bristles of each tuft is in the general form of a spiral.

6. A tool as set forth in claim 1 wherein each filament is generally rectangular in section and is oriented in the tool to present a flat side to the work.

7. A flexible abrasive grinding tool comprising a hub, bristles comprising stiff yet yielding abrasive loaded plastic filaments secured to and projecting from said hub, said bristles projecting radially and then being circumferentially curved whereby at the tool face the bristles extend circumferentially; said bristles being elastically shaped to form a predetermined curve which retains a curved shape.

8. A tool as set forth in claim 7 wherein the distal ends of said bristles overlap and are resiliently supported by adjacent bristles in the direction of curvature.

9. A tool as set forth in claim 8 wherein the direction of curvature is away from the intended direction of rotation of the tool.

10. A tool as set forth in claim 9 wherein such curvature is in the general form of a spiral.

11. A tool as set forth in claim 10 wherein each filament includes a flat side, and the curvature of each filament is such as to present such flat side to the work.

12. A tool as set forth in claim 11 wherein each filament is rectangular in section.

13. A tool as set forth in claim 12 wherein each filament is at least twice as wide as it is thick.

14. A tool as set forth in claim 13 wherein each filament is loaded with at least 30% by weight of abrasive material.

15. A tool as set forth in claim 14 wherein each filament is loaded with about 45% by weight of abrasive material.

16. A rotary tool comprising an array of flat abrasive loaded monofilaments, each monofilament extending radially and then curving circumferentially to present a side of the monofilament to the work; said monofilaments being elastically shaped to form a predetermined curve which retains a curved shape.

17. A tool as set forth in claim 16 wherein each monofilament includes a flat side surface, the curvature of the monofilament presenting such flat side surface to the work.

18. A tool as set forth in claim 17 wherein each monofilament is rectangular in section and contains from about 30 to about 45% by weight of abrasive mineral.

19. A method as set forth in claim 17 wherein such filaments are heated prior to bending and then cooled in such bent position.

20. A method of honing interior cylindrical metal surfaces comprising the steps of inserting a rotary tool into the cylindrical surface, such tool comprising abrasive loaded stiff yet flexible plastic filaments, such filaments extending radially from the hub and then curving to extend circumferentially of such interior surface, such insertion further increasing the curvature of the filaments, and then rotating such hub to cause the curved circumferentially extending portion of the filaments circumferentially to wipe the interior cylindrical surface.

21. A method of making an abrading tool comprising forming a tuft of abrasive loaded plastic filaments, and bending the filaments to a generally spiral form curvature, and assembling the tufts to a hub with such curvature of each tuft extending in the same direction.

22. A method of making an abrading tool comprising the step of assembling an array of tufts of radially extending abrasive loaded filaments on a hub, heating such filaments and constricting the filaments to cause each filament to curve in a common direction and cooling such filaments to impart a set curvature to each filament.

23. A method as set forth in claim 22 including the step of trimming such filaments to provide a circular tool face.

* * * * *